US007178361B2

(12) United States Patent
Thors et al.

(10) Patent No.: US 7,178,361 B2
(45) **Date of Patent: *Feb. 20, 2007**

(54) HEAT TRANSFER TUBES, INCLUDING METHODS OF FABRICATION AND USE THEREOF

(75) Inventors: Petur Thors, Decatur, AL (US); Tommy Tyler, Hartselle, AL (US)

(73) Assignee: Wolverine Tube, Inc., Huntsville, AL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/201,546

(22) Filed: Aug. 11, 2005

(65) Prior Publication Data

US 2006/0075773 A1 Apr. 13, 2006

Related U.S. Application Data

(63) Continuation of application No. 10/964,045, filed on Oct. 12, 2004, which is a continuation of application No. 10/328,848, filed on Dec. 24, 2002.

(60) Provisional application No. 60/374,171, filed on Apr. 19, 2002.

(51) Int. Cl.
*F25B 39/02* (2006.01)

(52) U.S. Cl. ..... 62/515; 165/184

(58) Field of Classification Search ..... 165/133, 165/181, 184, 177, 179, 911, DIG. 516; 62/515, 62/527

See application file for complete search history.

(56) References Cited

U.S. PATENT DOCUMENTS 3,583,533 A * 6/1971 Jones et al. ..... 188/218 R
3,696,861 A 10/1972 Webb
3,768,290 A * 10/1973 Zatell ..... 72/68
3,847,212 A 11/1974 Withers, Jr. et al.
3,881,342 A * 5/1975 Thorne ..... 72/68
4,059,147 A 11/1977 Thorne
4,159,739 A 7/1979 Brothers et al.
4,182,412 A 1/1980 Shum
4,195,688 A 4/1980 Fujie et al.
4,279,155 A 7/1981 Balkanli
4,313,248 A 2/1982 Fujikake
4,359,086 A 11/1982 Sanborn et al.
4,438,807 A 3/1984 Mathur et al.
4,602,681 A 7/1986 Daikoku et al.
4,606,405 A 8/1986 Nakayama et al.
4,660,630 A 4/1987 Cunningham et al.
4,715,436 A 12/1987 Takahashi et al.
4,765,058 A 8/1988 Zohler (Continued)

FOREIGN PATENT DOCUMENTS

DE 2239069 * 10/1974
JP 56-059194 5/1981
JP 03-230094 A 10/1991
JP 5-180537 7/1993

*Primary Examiner*—Mohammad M. Ali
(74) *Attorney, Agent, or Firm*—Kilpatrick Stockton LLP; Kristin J. Doyle

(57) ABSTRACT

The present invention discloses an improved heat transfer tube, an improved method of formation, and an improved use of such heat transfer tube. The present invention discloses a boiling tube for a refrigerant evaporator that provides at least one dual cavity nucleate boiling site. The present invention further discloses an improved refrigerant evaporator including at least one such boiling tube, and the method of making such a boiling tube.

20 Claims, 11 Drawing Sheets

U.S. PATENT DOCUMENTS 5,054,548 A 10/1991 Zohler
5,146,979 A 9/1992 Zohler
5,186,252 A 2/1993 Nishizawa et al.
5,222,299 A 6/1993 Zohler
5,333,682 A 8/1994 Liu et al.
5,415,225 A 5/1995 Randlett et al.
5,526,626 A * 6/1996 Loucks ..... 52/518
5,669,441 A * 9/1997 Spencer ..... 165/184
5,697,430 A 12/1997 Thors et al.
5,781,996 A * 7/1998 Spencer ..... 29/890.048
5,832,995 A 11/1998 Chiang et al.
5,996,686 A * 12/1999 Thors et al. ..... 165/179
6,167,950 B1 1/2001 Gupte et al.
6,910,607 B2 * 6/2005 Gaiser et al. ..... 222/490
2006/0075772 A1 4/2006 Thors

* cited by examiner

η vs. Flow Rate $St_e/St_s$ vs. Flow Rate $Dp_e/Dp_s$ vs. Flow Rate

Overall Coefficient vs. Heat Flux

HEAT TRANSFER TUBES, INCLUDING METHODS OF FABRICATION AND USE THEREOF

RELATED APPLICATIONS

This application is a continuation of U.S. application Ser. No. 10/964,045 filed Oct. 12, 2004, which is a continuation of U.S. application Ser. No. 10/328,848 filed Dec. 24, 2002, which claims the benefit of U.S. Provisional Application Serial No. 60/374,171 filed Apr. 19, 2002.

FIELD OF INVENTION

The present invention relates generally to heat transfer tubes, their method of formation and use. More particularly, the present invention relates to an improved boiling tube, a method of manufacture and use of that tube in an improved refrigerant evaporator or chiller.

BACKGROUND OF THE INVENTION

A component device of industrial air conditioning and refrigeration systems is a refrigerant evaporator or chiller. In simple terms, chillers remove heat from a cooling medium that enters the unit, and deliver refreshed cooling medium to the air conditioning or refrigeration system to effect cooling of a structure, device or given area. Refrigerant evaporators on chillers use a liquid refrigerant or other working fluid to accomplish this task. Refrigerant evaporators on chillers lower the temperature of a cooling medium, such as water (or some other fluid), below that which could be obtained from ambient conditions for use by the air conditioning or refrigeration system.

One type of a chiller is a flooded chiller. In flooded chiller applications, a plurality of heat transfer tubes are fully submerged in a pool of a two-phase boiling refrigerant. The refrigerant is often a chlorinated-fluorinated hydrocarbon (i.e., "Freon") having a specified boiling temperature. A cooling medium, often water, is processed by the chiller. The cooling medium enters the evaporator and is delivered to the plurality of tubes, which are submerged in a boiling liquid refrigerant. As a result, such tubes are commonly known as "boiling tubes." The cooling medium passing through the plurality of tubes is chilled as it gives up its heat to the boiling refrigerant. The vapor from the boiling refrigerant is delivered to a compressor which compresses the vapor to a higher pressure and temperature. The high pressure and temperature vapor is then routed to a condenser where it is condensed for eventual return through an expansion device to the evaporator to lower the pressure and temperature. Those of ordinary skill in the art will appreciate that the foregoing occurs in keeping with the well-known refrigeration cycle.

It is known that heat transfer performance of a boiling tube submerged in a refrigerant can be enhanced by forming fins on the outside surface of the tube. It is also known to enhance the heat transfer ability of a boiling tube by modifying the inner tube surface that contacts the cooling medium. One example of such a modification to the inner tube surface is shown in U.S. Pat. No. 3,847,212, to Wither, Jr., et al., which teaches forming ridges on a tube's inner surface.

It is further known that the fins can be modified to further enhance heat transferability. For example, some boiling tubes have come to be referred to as nucleate boiling tubes. The outer surface of nucleate boiling tubes are formed to produce multiple cavities or pores (often referred to as boiling or nucleation sites) that provide openings which permit small refrigerant vapor bubbles to be formed therein. The vapor bubbles tend to form at the base or root of the nucleation site and grow in size until they break away from the outer tube surface. Upon breaking away, additional liquid refrigerant takes the vacated space and the process is repeated to form other vapor bubbles. In this manner, the liquid refrigerant is boiled off or vaporized at a plurality of nucleate boiling sites provided on the outer surface of the metallic tubes.

U.S. Pat. No. 4,660,630 to Cunningham et al. shows nucleate boiling cavities or pores formed by notching or grooving fins on the outer surface of the tube. The notches are formed in a direction essentially perpendicular to the plane of the fins. The inner tube surface includes helical ridges. This patent also discloses a cross-grooving operation that deforms the fin tips such that nucleate boiling cavities (or channels) are formed having a greater width than the surface openings. This construction permits the vapor bubbles to travel outwardly through the cavity, to and through the narrower surface openings, which further enhances heat transferability. Various tubes produced in accordance with the Cunningham et al. patent have been marketed by Wolverine Tube, Inc. under the trademark TURBO-B®. In another nucleate boiling tube, marketed under the trademark TURBO-BII®, the notches are formed at an acute angle to the plane of the fins.

In some heat transfer tubes, the fins are rolled over and/or flattened after they are formed so as to produce narrow gaps which overlie the larger cavities or channels defined by the roots of the fins and the sides of adjacent pairs of fins. Examples include the tubes of the following United States patents: Cunningham et al U.S. Pat. No. 4,660,630; Zohler U.S. Pat. No. 4,765,058; Zohler U.S. Pat. No. 5,054,548; Nishizawa et al U.S. Pat. No. 5,186,252; Chiang et al U.S. Pat. No. 5,333,682.

Controlling the density and size of nuclear boiling pores has been recognized in the prior art. Moreover, the interrelationship between pore size and refrigerant type has also been recognized in the prior art. For example, U.S. Pat. No. 5,146,979 to Bohler purports to increase performance using higher pressure refrigerants by employing tubes having nucleate boiling pores ranging in size from 0.000220 square inches to 0.000440 square inches (the total area of the pods being from 14% to 28% of the total outer surface area). In another example, U.S. Pat. No. 5,697,430 to Thors et al. also discloses a heat transfer tube having a plurality of radially outwardly extending helical fins. The tube inner surface has a plurality of helical ridges. The fins of the outer surface are notched to provide nucleate boiling sites having pores. The fins and notches are spaced to provide pores having an average area less than 0.00009 square inches and a pore density of at least 2000 per square inch of the tube's outer surface. The helical ridges on the inner surface have a predetermined ridge height and pitch, and are positioned at a predetermined helix angle. Tubes made in accordance with the inventions of that patent have been offered and sold under the trademark TURBO BIII®.

The industry continues to explore new and improved designs by which to enhance heat transfer and chiller performance. For example, U.S. Pat. No. 5,333,682 discloses a heat transfer tube having an external surface configured to provide both an increased area of the tube's external surface and to provide re-entrant cavities as nucleation sites to promote nucleate boiling. Similarly, U.S. Pat. No. 6,167,950 discloses a heat transfer tube for use in a condenser with notched and finned surfaces configured to promote drainage of refrigerant from the fin. As shown by such developments in the art, it remains a goal to increase the heat transfer performance of nucleate boiling tubes while maintaining manufacturing cost and refrigeration system operation costs at minimum levels. These goals include the design of more efficient tubes and chillers, and methods of manufacturing such tubes. Consistent with such goals, the present invention is directed to improving the performance of heat exchange tubes generally and, in particular, the performance of heat exchange tubes used in flooded chillers or falling film applications.

SUMMARY OF THE INVENTION

The present invention improves upon prior heat exchange tubes and refrigerant evaporators by forming and providing enhanced nucleate boiling cavities to increase the heat exchange capability of the tube and, as a result, performance of a chiller including one or more of such tubes. It is to be understood that a preferred embodiment of the present invention comprises or includes a tube having at least one dual cavity boiling cavity or pore. While the tubes disclosed herein are especially effective in use in boiling applications using high pressure refrigerants, they may be used with low pressure refrigerants as well.

The present invention comprises an improved heat transfer tube. The improved heat transfer tube of the present invention is suitable for boiling or falling film evaporation applications where the tube's outer surface contacts a boiling liquid refrigerant. In a preferred embodiment, a plurality of radially outwardly extending helical fins are formed on the outer surface of the tube. The fins are notched and the tips bent over to form nucleate boiling cavities. The roots of the fins may be notched to increase the volume or size of the nucleate boiling cavities. The top surface of the fins are bent over and rolled to form a second pore cavity. The resultant configuration defines dual cavity pores or channels for enhanced production of vaporization bubbles. The internal surface of the tube may also be enhanced, such as by providing helical ridges along the internal surface, to further facilitate heat transfer between the cooling medium flowing through the tube and the refrigerant in which the tube may be submerged. Of course, the present invention is not limited by any particular internal surface enhancement.

The present invention further comprises a method of forming an improved heat transfer tube. A preferred embodiment of the invented method includes the steps of forming a plurality of radially outwardly extending fins on the outer surface of the tube, and bending the fins on the outer surface of the tube, notching and bending the left over (remaining between notches) material to form dual cavity nucleate boiling sites which enhance heat transfer between the cooling medium flowing through the tube and the boiling refrigerant in which the tube may be submerged.

The present invention further comprises an improved refrigerant evaporator. The improved evaporator, or chiller, includes at least one tube made in accordance with the present invention that is suitable for boiling or falling film evaporation applications. In a preferred embodiment, the exterior of the tube includes a plurality of radially outwardly extending fins. The fins are notched. The fins are bent to increase the available surface areas on which heat transfer may occur and to form nucleate dual cavity boiling sites, thus enhancing heat transfer performance.

It is an object of the present invention to provide an improved heat transfer tube.

It is another object of the present invention to provide an improved heat transfer tube that is suitable for both flooded and falling film evaporator applications.

It is another object of the present invention to provide an improved heat transfer tube that defines least one dual cavity nucleate boiling site.

It is another object of the present invention to provide a method of manufacturing a heat transfer tube for boiling and falling film applications, wherein at least one dual cavity nucleate boiling site is located on the outer tube surface to enhance the heat transfer capability of the tube.

It is another object of the present invention to provide an improved nucleate boiling tube for applications wherein fins formed on the outer tube surface have been bent to provide additional surface area for convective vaporization to thereby enhance the heat transfer capability of the tube.

It is still another object of the present invention to provide a heat transfer tube which includes surface enhancements to the outer tube surface that can be produced in a single pass by finning equipment.

It is still another object of the present invention to provide a heat transfer tube which includes surface enhancements to the inner tube surface which facilitate flow of liquid inside the tube, increase the internal surface area, and facilitate contact between the liquid and internal surface area so as to further enhance the heat transfer capability of the tube.

It is still another object of the present invention to provide a method to make an improved heat transfer tube that defines at least one dual cavity nucleate boiling site.

It is still another object of the present invention to provide an improved refrigerant evaporator.

It is yet another object of the present invention to provide an improved refrigerant evaporator having at least one heat transfer tube having at least one dual cavity nucleate boiling site.

It is yet another object of the present invention to provide an improved refrigerant evaporator having a plurality of heat transfer tubes wherein each of such tubes defines a plurality of dual cavity nucleate boiling sites.

It is yet another object of the present invention to provide an improved refrigerant evaporator having at least one heat transfer tube that is provided with dual-cavity nucleate boiling sites.

It is yet another object of the present invention to provide a method of forming a heat transfer tube by bending the fins to define multiple cavity nucleate boiling sites.

These and other features and advantages of the present invention will be demonstrated and understood by reading the present specification including the appended drawings.

DETAILED DESCRIPTION OF THE PREFERRED EMBODIMENTS

Figure 1:
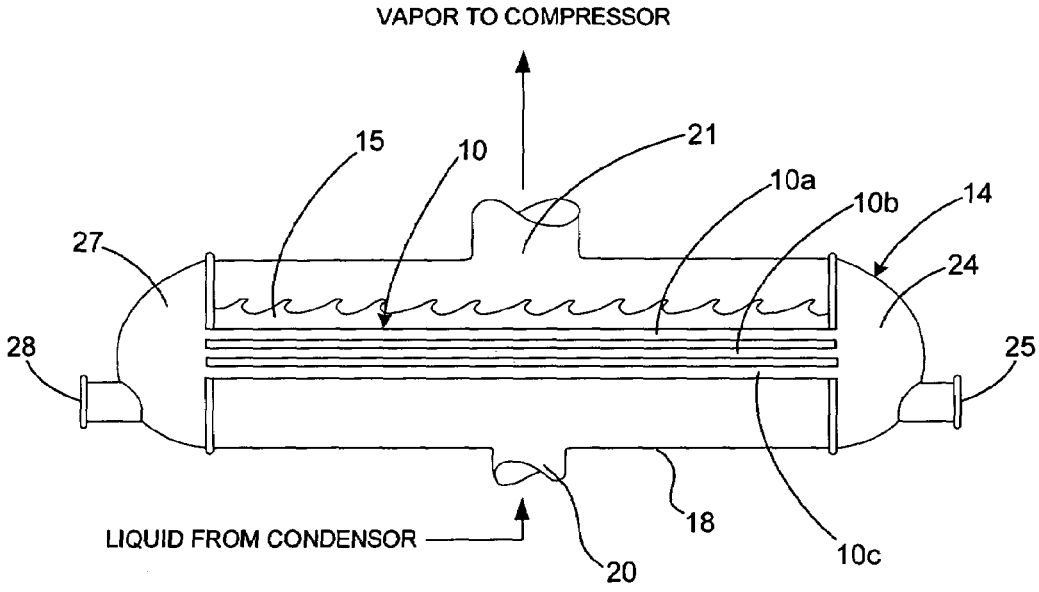
FIG. 1 is an illustration of a refrigerant evaporator made in accordance with the present invention.

Referring now in detail to the drawings, in which like numerals indicate like parts throughout, FIG. 1 shows a plurality of heat transfer tubes made in accordance with the present invention generally at 10. The tubes 10 are contained within a refrigerant evaporator 14. Individual tubes 10*a*, 10*b* and 10*c* are representative, as those of ordinary skill will appreciate, of the potentially hundreds of tubes 10 that are commonly contained in the evaporator 14 of a chiller. The tubes 10 may be secured in any suitable fashion to accomplish the inventions as described herein. The evaporator 14 contains a boiling refrigerant 15. The refrigerant 15 is delivered to the evaporator 14 from a condenser into a shell 18 by means of an opening 20. The boiling refrigerant 15 in the shell 18 is in two phases, liquid and vapor. Refrigerant vapor escapes the evaporator shell 18 through a vapor outlet 21. Those of ordinary skill will appreciate that the refrigerant vapor is delivered to a compressor where it is compressed into a higher temperature and pressure vapor, for use in keeping with the known refrigeration cycle.

A plurality of heat transfer tubes 10*a–c*, which are described in greater detail herein, are placed and suspended within the shell 18 in any suitable maimer. For example, the tubes 10*a–c* may be supported by baffles and the like. Such construction of a refrigerant evaporator is known in the art. A cooling medium, oftentimes water, enters the evaporator 14 through an inlet 25 and into an inlet reservoir 24. The cooling medium, which enters the evaporator 14 in a relatively heated state, is delivered from the reservoir 24 into the plurality of heat exchange tubes 10*a–c*, wherein the cooling medium gives up its heat to the boiling refrigerant 15. The chilled cooling medium passes through the tubes 10*a–c* and exits the tubes into an outlet reservoir 27. The refreshed cooling medium exits the evaporator 14 through an outlet 28. Those of ordinary skill will appreciate that the example flooded evaporator 14 is but one example of a refrigerant evaporator. Several different types of evaporators are known and utilized in the field, including the evaporator on absorption chillers, and those employing falling film applications. It will be further appreciated by those of ordinary skill, that the present invention is applicable to chillers and evaporators generally, and that the present invention is not limited to brand or type.

Figure 2:
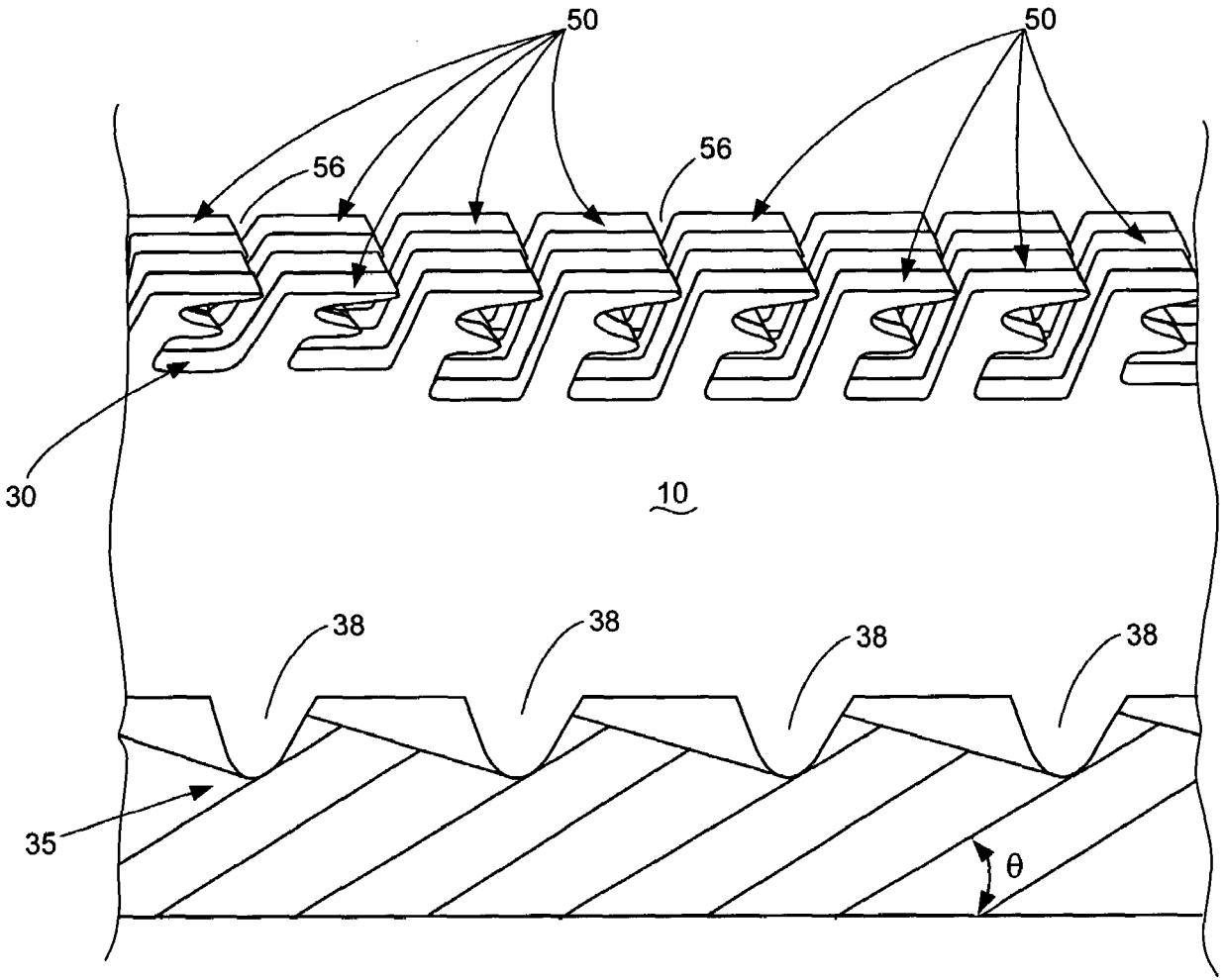
FIG. 2 is an enlarged, partially broken away axial cross-sectional view of a heat transfer tube made in accordance with the present invention.
Figure 3:
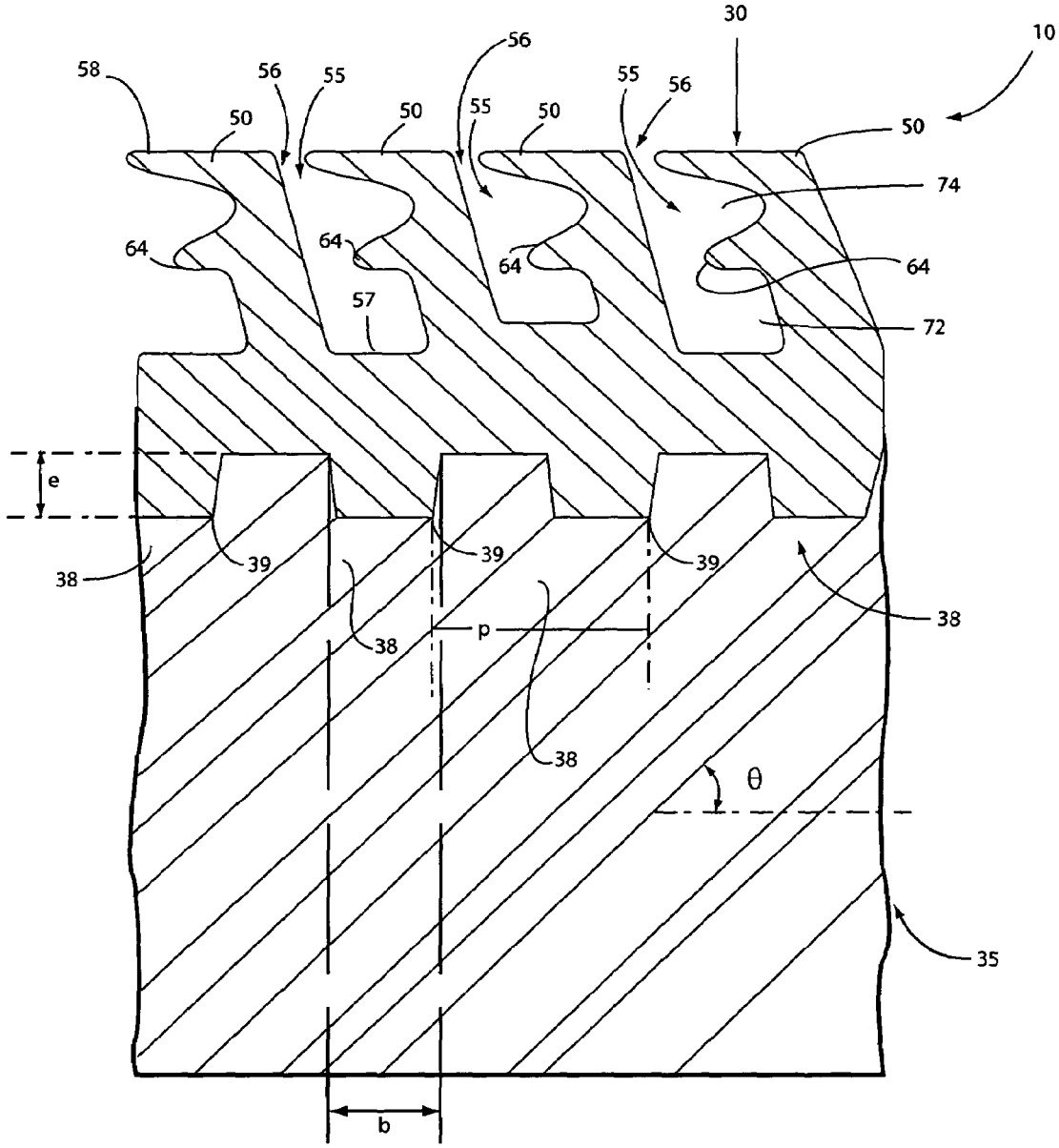
FIG. 3 is an enlarged, partially broken away axial cross-sectional illustration of a preferred embodiment of a heat transfer tube made in accordance with the present invention.

FIG. 2 is an enlarged, broken away, plan view of a representative tube 10. FIG. 3, which is an enlarged cross-sectional view of a preferred tube 10, is readily considered in tandem with FIG.2. Referring first to FIG. 2, the tube 10 defines an outer surface generally at 30, and an inner surface generally at 35. The inner surface is preferably provided with a plurality of ridges 38. Those of ordinary skill in the art will appreciate that the inner tube surface may be smooth, or may have ridges and grooves, or may be otherwise enhanced. Thus, it is to be understood that the presently disclosed embodiment, while showing a plurality of ridges, is not limiting of the invention.

Turning to the exemplary embodiment, ridges 38 on the inner tube surface 35 have a pitch "p," a width "b," and a height "e," each determined as shown in FIG. 3. The pitch "p" defines the distance between ridges 38. The height "e" defines the distance between a ceiling 39 of a ridge 38 and the innermost portion of the ridge 38. The width "b" is measured at the uppermost, outside edges of the ridge 38 where contact is made with the ceiling 39. A helix angle "0" is measured from the axis of the tube, as also indicated in FIG. 3. Thus, it is to be understood that the inner surface 35 of tube 10 (of the exemplary embodiment) is provided with helical ridges 38, and that these ridges have a predetermined ridge height and pitch and are aligned at a predetermined helix angle. Such predetermined measurements may be varied as desired, depending on a particular application. For example, U.S. Pat. No. 3,847,212 to Withers, Jr. taught a relatively low number of ridges, at a relatively large pitch (0.333 inch) and a relatively large helix angle (51°). These parameters are preferably selected to enhance the heat transfer performance of the tube. The formation of such interior surface enhancements is well known to those of ordinary skill in the art and need not be disclosed in further detail other than as disclosed herein. It is to be recognized, for example, that U.S. Pat. No. 3,847,212 to Wither, Jr. et al. discloses a method of formation, and formation, of interior surface enhancements.

The outer surface 30 of the tubes 10 is typically, initially smooth. Thus, it will be understood that the outer surface 30 is thereafter deformed or enhanced to provide a plurality of fins 50 that in turn provide, as described in detail herein, multiple dual-cavity nucleate boiling sites 55. While the present invention is described in detail regarding dual cavity nucleate pores, it is to be understood that the present invention includes heat transfer tubes 10 having nucleate boiling sites 55 made with more than two cavities. These sites 55, which are typically referred to as cavities or pores, include openings 56 provided on the structure of the tube 10, generally on or under the outer surface 30 of the tube. The openings 56 function as small circulating systems which direct liquid refrigerant into a loop or channel, thereby allowing contact of the refrigerant with a nucleation site. Openings of this type are typically made by finning the tube, forming generally longitudinal grooves or notches in the tips of the fins and then deforming the outer surface to produce flattened areas on the tube surface but have channels in the fin root areas.

Turning in greater detail to FIGS. 2 and 3, outer surface 30 of tube 10 is formed to have a plurality of fins 50 provided thereon. Fins 50 may be formed using a conventional finning machine in a manner understood with reference to U.S. Pat. No. 4,729,155 to Cunningham et al., for example. The number of arbors utilized depends on such manufacturing factors as tube size, throughput speed, etc. The arbors are mounted at appropriate degree increments around the tube, and each is preferably mounted at an angle relative to the tube axis.

Figure 4:
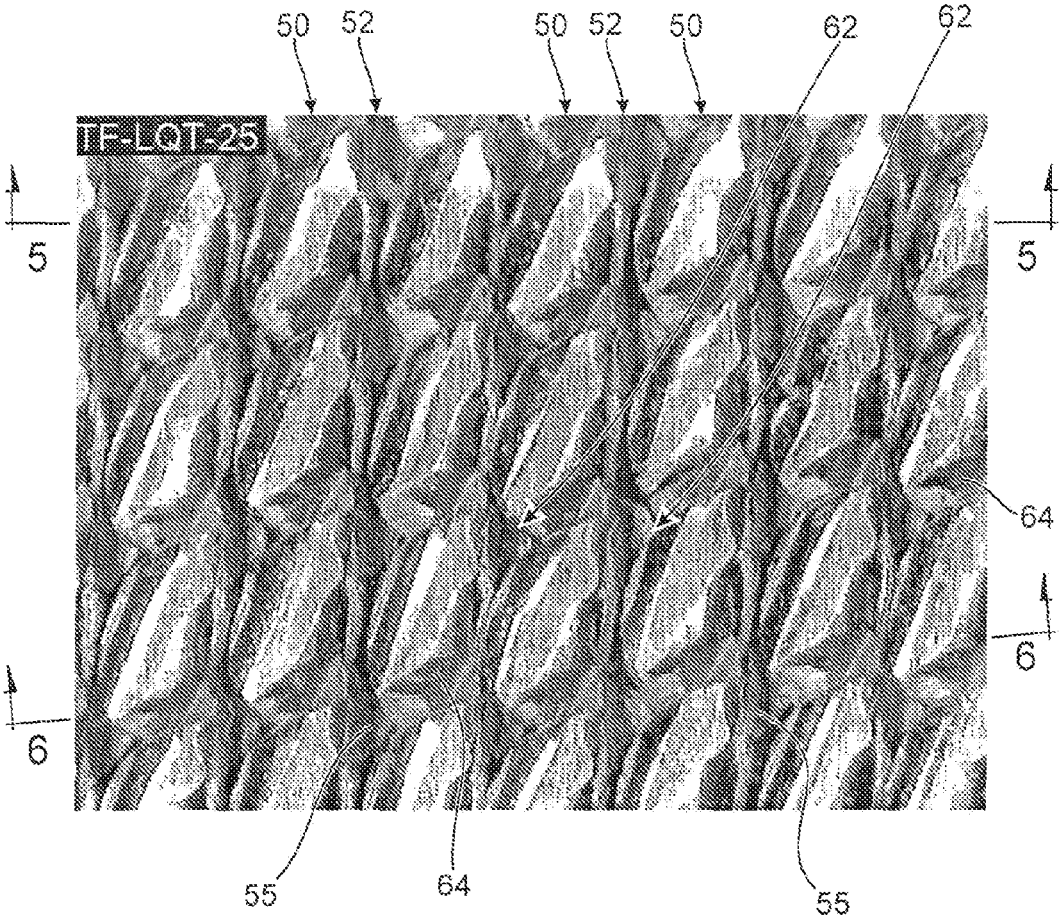
FIG. 4 is a photomicrograph of the outer surface of the tube of FIG. 2.
Figure 5:
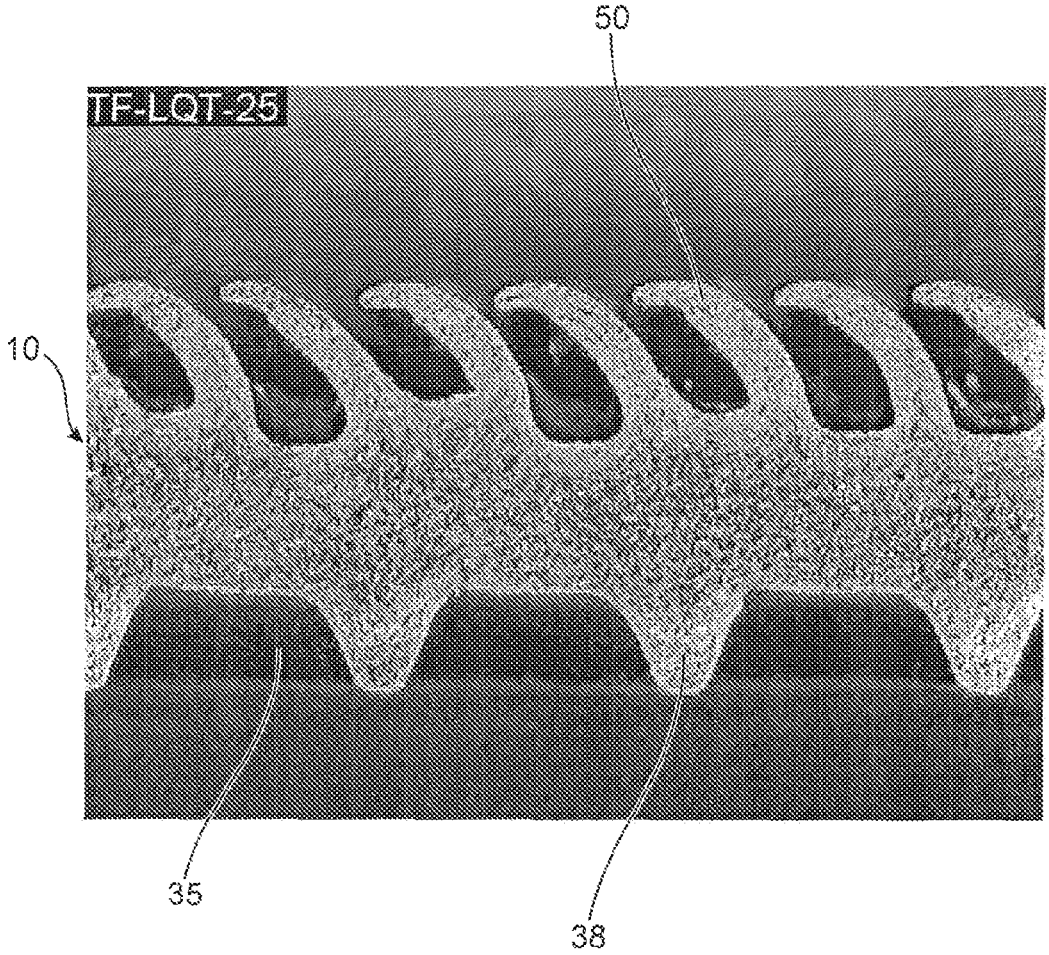
FIG. 5 is a cross-section taken along line 5—5 in FIG. 4.
Figure 7:
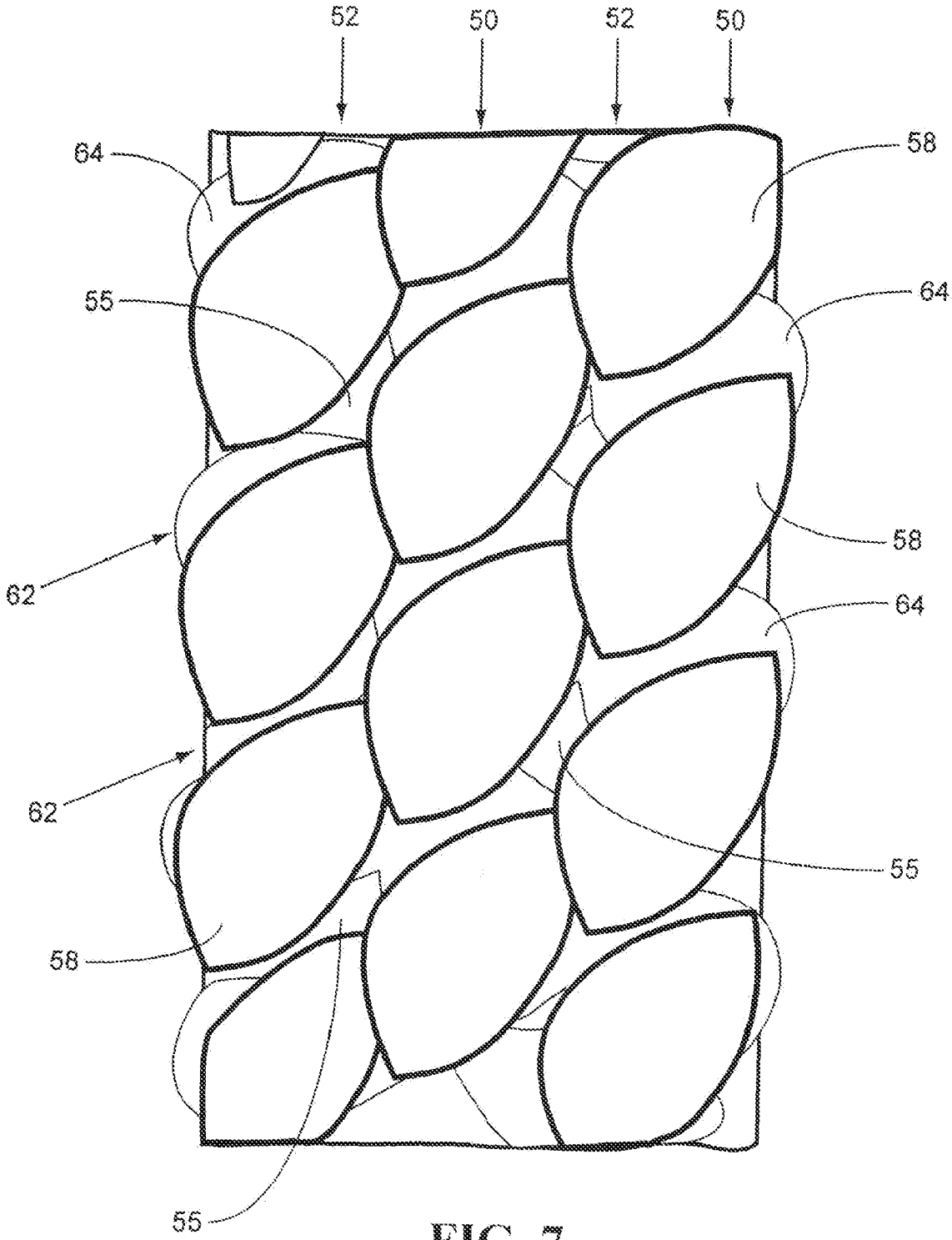
FIG. 7 is a schematic depiction of the outer surface of the tube of FIG. 3.

Described in even greater detail, and focusing on FIGS. 4 and 7, the finning disks push or deform metal on the outer surface 30 of the tube to form fins 50, and relatively deep grooves or channels 52. As shown, the channels 52 are formed between the fins 50, and both are generally circumferential about the tube 10. As shown in FIG. 3, the fins 50 have a height, which may be measured from the innermost portion 57 of a channel 52 (or a groove) and the outermost surface 58 of a fin. Moreover, the number of fins 50 may vary depending upon the application. While not limiting, a preferred range of fin height is between 0.015 and 0.060 inches, and a preferred count of fins per inch is between 40 to 70. It is then to be understood that the finning operation produces a plurality of first channels 52, as shown in FIGS. 4 and 7.

Figure 6:
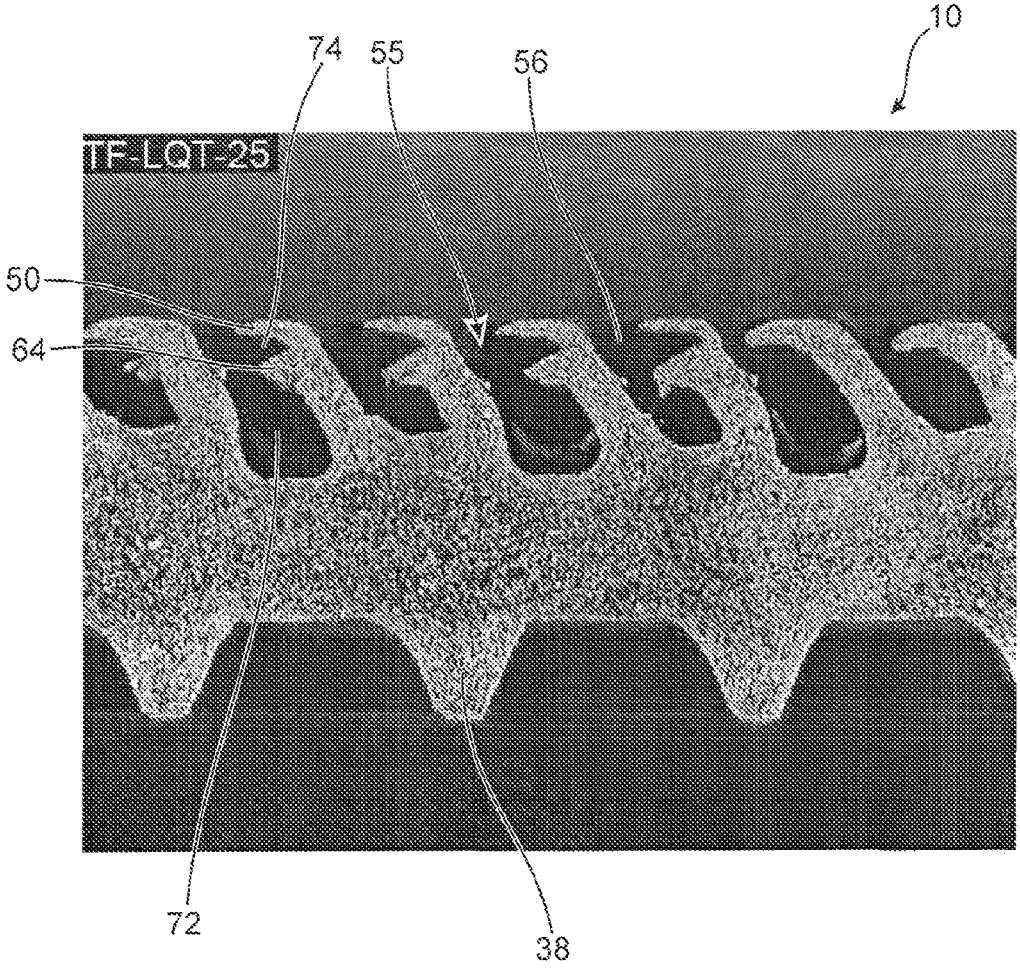
FIG. 6 is a cross-section taken along line 6—6 in FIG. 4.

After fin formation, the outer surface 58 of each fin 50 is notched to provide a plurality of second channels 62. Such notching may be performed using a notching disk (see reference in U.S. Pat. No. 4,729,155 to Cunningham, for example). The second channels 62, which are positioned at an angle relative to the first channels 52, interconnect therewith as shown in FIGS. 4 and 7. The notching operation described in U.S. Pat. No. 5,697,430, is one appropriate method for performing this notching operation so as to define the second channels 62, and to form a plurality of notches 64. As seen in FIGS. 3 and 6, notches 64 extend at least partially over channels 52 to form the primary nucleate boiling cavities 72.

After notching, the outer surface 58 of the fins 50 are flattened or bent over by means of a compression disk (see reference in U.S. Pat. No. 4,729,155 to Cunningham, for example). This step flattens or bends over the top or heads of each fin, to create an appearance as shown, for example as in FIGS. 4 and 7. It is to be understood that the foregoing operations create a plurality of pores 55 at the intersection of channels 52 and 62. These pores 55 define nucleate boiling sites and each is defined by a pore size.

After flattening, the fins 50 are rolled or bent once again by a rolling tool. The rolling operation exerts a force across and over the fins 50. The fins 50 are bent or rolled by a tool so as to at least partially cover the fin notches 64 and thereby form secondary boiling cavities 74 between the bent fins 50 and the fin notches 64. The secondary cavities 74 provide extra fin area above the primary cavities 72 to promote more convective and nucleation boiling. Thus, pores 55 are formed at the intersection of channels 52 and 62. Each pore 55 has a pore opening 56, which is the size of the opening from the boiling or nucleation site from which vapor escapes. The preferred embodiment of the present invention defines two cavities, primary cavity 72 and secondary cavity 74, which enhances performance of the tube.

The tube 10 is preferably notched in the first channels 52 between the fins ("fin root area") to thereby form root notches in the root surface. The notching is accomplished using a root notching disk. While root notches of a variety of shapes and sizes may be notched in the fin root area, formation of root notches having a generally trapezoidal shape are preferable. While any number of root notches may be formed around a circumference of each groove 52, at least 20 to 100, preferably forty-seven (47), root notches per circumference are recommended. Moreover, root notches preferably have a root notch depth of between 0.0005 inches to 0.005 inches and more preferably 0.0028 inches.

Enhancements to both the inner surface 35 and the outer surface 30 of tube 10 increase the overall efficiency of the tube by increasing both the outside ($h_o$) and inside ($h_i$) heat transfer coefficients and thereby the overall heat transfer coefficient ($U_o$), as well as reducing the total resistance to transferring heat from one side to another side of the tube ($R_T$). The parameters of the inner surface 35 of tube 10 enhance the inside heat transfer coefficient ($h_i$) by providing increased surface area against which the fluid may contact and also permitting the fluid inside tube 10 to swirl as it traverses the length of tube 10. The swirling flow tends to keep the fluid in good heat transfer contact with the inner surface but avoids excessive turbulence which could provide an undesirable increase in pressure drop.

Moreover root notching the outer surface 30 of the tube and bending (as opposed to the traditional flattening) of the fins 50 facilitate heat transfer on the exterior of the tube and thereby increase the outside heat transfer coefficient ($h_o$). The root notches increase the size and surface area of the nucleate boiling cavities and the number of boiling sites and help keep the surface wetted as a result of surface tension forces which helps promote more thin film boiling where it is needed. Fin bending results in formation of an additional cavities (such as secondary cavity 74) positioned over each primary cavity 50 which can serve to transfer additional heat to the refrigerant and through the liquid vapor inter-phase of a rising vapor bubble escaping from the secondary cavity 74 by means of convection and/or nucleate boiling depending on heat flux and liquid/vapor movement over the outside surface of the tube. As one skilled in the art will appreciate, the outside boiling coefficient is a function of both a nucleate boiling term and a convective component. While the nucleate boiling term is usually contributing the most to the heat transfer, the convective term is also important and can become substantial in flooded refrigerant chillers.

Tube 10 of the present invention in respects outperforms the tube disclosed in U.S. Pat. No. 5,697,430 (designated as "T-BIII® Tube" in the subsequently-described tables and graphs), which is currently regarded as the leading performer in evaporation performance among widely commercialized tubes. In order to allow a comparison of the improved tube 10 of the present invention (designated as "New Tube" in the subsequently-described tables and graphs) to the T-BIII® Tube, Table 1 is provided to describe dimensional characteristics of the New Tube and T-BIII® Tube:

TABLE 1

DIMENSIONAL CHARACTERISTICS OF COPPER TUBES HAVING MULTIPLE-START INTERNAL RIDGING

| TUBE DESIGNATION | T-BIII ® Tube | New Tube |
|---|---|---|
| PRODUCT NAME | Turbo-BIII ® | Turbo-EDE ® |
| FPI = fins per inch (fpi) | 60 | 48 |
| Posture of Fins | Mangled | Mangled |
| FH = Fin Height (inches) | .0215 | .021 |
| Ao = True Outside Area ($ft^2/ft$) | Unknown | Unknown |
| $d_i$ = Inside Diameter (inches) | .645 | .652 |
| e = Ridge Height (inches) | .016 | .014 |
| p = Axial Pitch of Ridge (inches) | .0516 | .0457 |
| $N_{RS}$ = Number of Ridge Starts | 34 | 44 |
| l = Lead (inches) | 1.76 | 2.01 |
| θ =Lead Angle of Ridge from Axis (°) | 49 | 45 |
| b = Ridge Width Along Axis (inches) | .0265 | .0184 |

Table 2 compares the inside performance of the New Tube and T-BIII Tube. Both tubes are compared at constant tube side water flow rate of 5 GPM and constant average water temperature of 50° F. Comparisons in Table 2 are based on nominal ¾ inch outside diameter tubes.

TABLE 2

TUBE SIDE PERFORMANCE CHARACTERISTICS OF EXPERIMENTAL COPPER TUBES HAVING MULTIPLE-START INTERNAL RIDGING

| | T-BIII Tube | New Tube |
|---|---|---|
| u = Intube Water Velocity (ft/s) | 4.89 | 4.78 |
| $C_i$ = Inside Heat Transfer Coefficient Constant (From Test Results) | .075 | 0.077 |

TABLE 2-continued

TUBE SIDE PERFORMANCE CHARACTERISTICS OF EXPERIMENTAL COPPER TUBES HAVING MULTIPLE-START INTERNAL RIDGING

| | T-BIII Tube | New Tube |
|---|---|---|
| $f_D$ = Friction Factor (Darcy) | 0.0624 | 0.0623 |
| $\Delta p_e$/ft = Pressure Drop per Foot | 0.187 | 0.177 |
| $St_e/St_s$ = Stanton Number Ratio (enhanced/Smooth) | 2.52 | 2.59 |
| $\Delta p_e/\Delta p_s$ = Pressure Drop Ratio (Enhanced/Smooth) | 3.34 | 3.16 |
| $\eta = (St_e/St_s)/(\Delta p_e/\Delta p_s)$ = Efficiency index | 0.78 | 0.82 |

Figure 8:
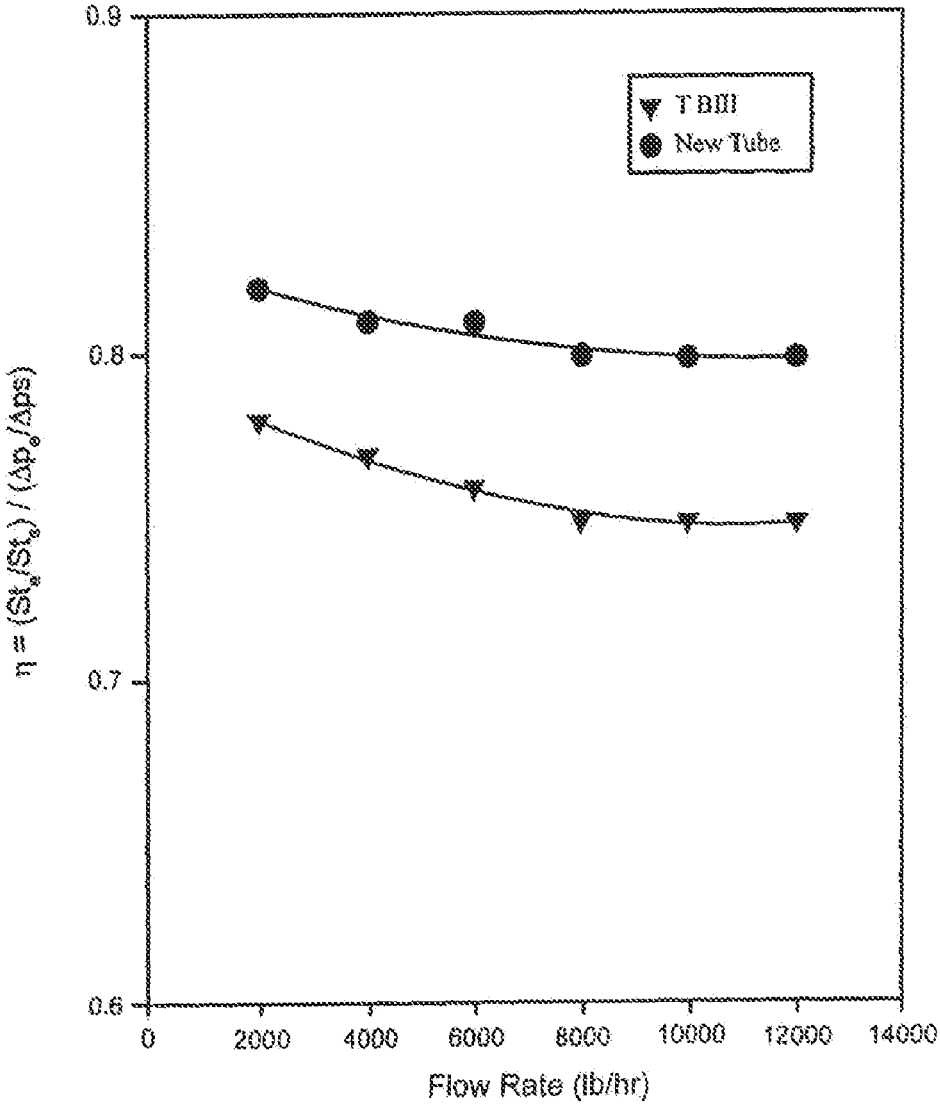
FIG. 8 is a graph comparing an efficiency index for the tube of the present invention and a heat exchange tube made in accordance with the inventions disclosed in U.S. Pat. No. 5,697,430.
Figure 9:
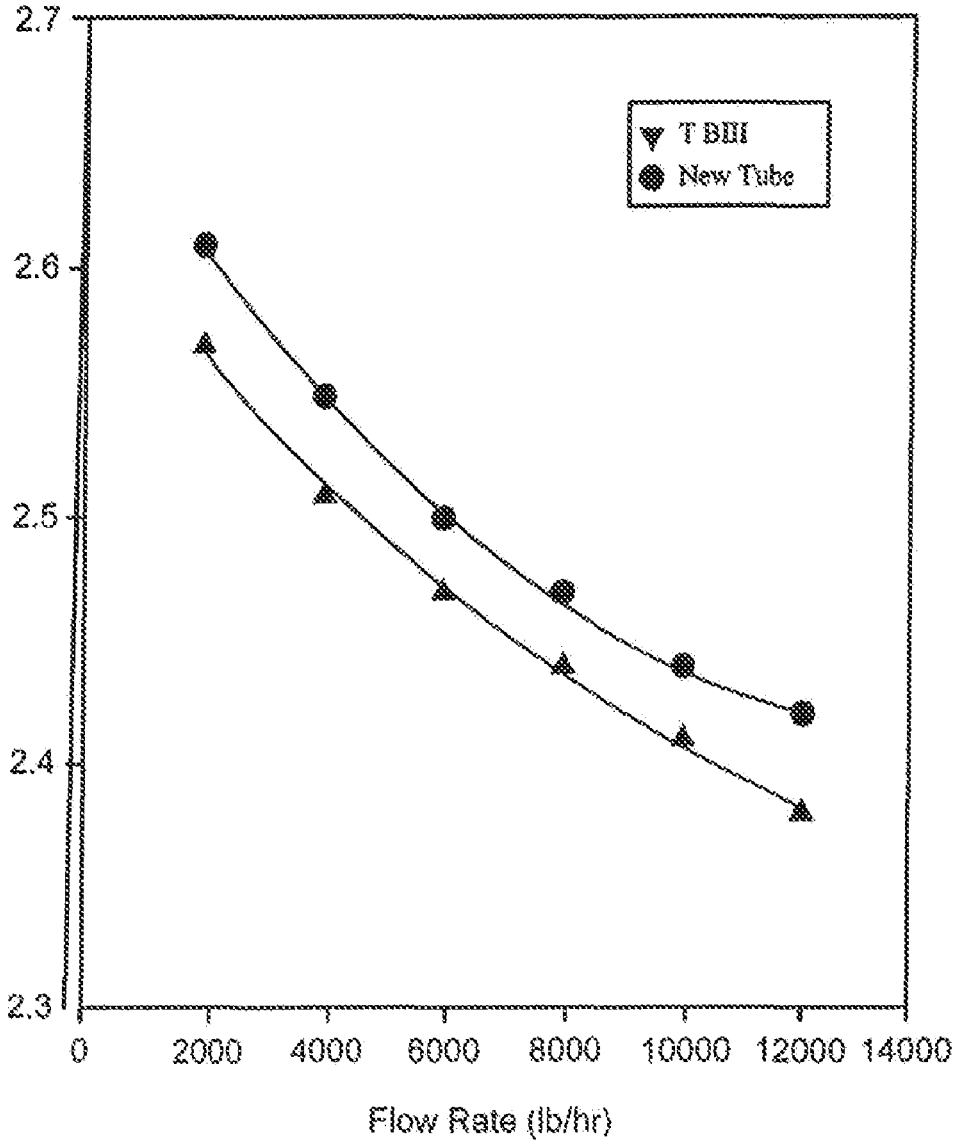
FIG. 9 is a graph comparing the inside heat transfer performance of the tube of the present invention and a heat exchange tube made in accordance with the inventions disclosed in U.S. Pat. No. 5,697,430.
Figure 10:
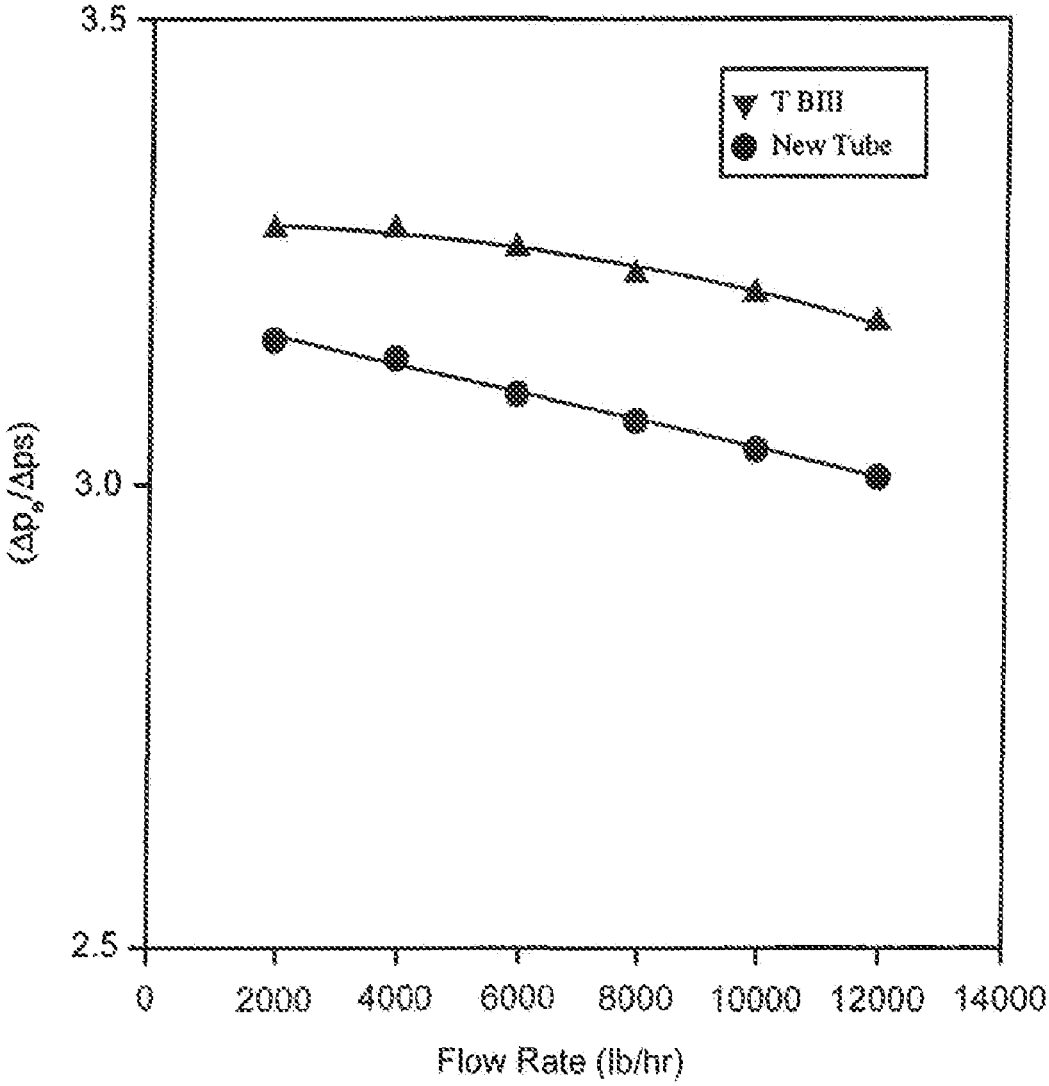
FIG. 10 is a graph comparing the pressure drop of the tube of the present invention and a heat exchange tube made in accordance with the inventions disclosed in U.S. Pat. No. 5,697,430.

The data illustrates the reduction in pressure drop and increase in heat transfer efficiency achieved with the New Tube. As can be seen in Table 2 and graphically illustrated in FIG. 10, the pressure drop ratio ($\Delta p_e/\Delta p_s$) relative to a smooth bore tube, at 5 GPM constant flow rate, for the New Tube is approximately 5% less than for the T-BIII Tube. Also from Table 2 and graphically illustrated in FIG. 9, one can see that the Stanton Number ratio ($St_e/St_s$) of the New Tube is approximately 2% higher than for the T-BIII® Tube. The pressure drop and Stanton Number ratios can be combined into a total ratio of heat transfer to pressure drop and is defined as the "efficiency index" ($\eta$), which is a total measure of heat transfer to pressure drop compared to a smooth bore tube. At 5 GPM, the efficiency index $\eta$ for the New Tube is 0.82 and for the T-BIII® Tube is 0.78, resulting in an approximately 5% improvement with the New Tube, as graphically illustrated in FIG. 8, at this GPM. At 7 GPM (usual operating condition), higher percentage improvement would be obtained.

Table 3 compares the outside performances of the New Tube and the T-BIII® Tube. The tubes are eight feet long and each is separately suspended in a pool of refrigerant temperature of 58.3 depress Fahrenheit. The water flow rate is held constant at 5.3 ft/s and the inlet water temperature is such that the average heat flux for all tubes is held at 7000 Btu/hr ft$^2$ which is constant. The tubes are made of copper material, have a nominal ¾ inch outer diameter, and have the same wall thickness. All tests are performed without any oil present in the refrigerant.

TABLE 3

OUTSIDE AND OVERALL PERFORMANCE CHARACTERISTICS OF EXPERIMENTAL COPPER TUBES HAVING MULTIPLE-START INTERNAL RIDGING

| | T-BIII Tube | New Tube |
|---|---|---|
| $h_o$ = Average Boiling Coefficient based on Nominal Outside Area HFC-134A Refrigerant (Btu/hr ft$^2$ F.) | 10,000 | 13,000 |
| $U_o$ = Overall Heat Transfer Coefficient, Based on Nominal Outside Area in HFC-134a Refrigerant (Btu/hr ft$^2$ F.) | 1,960 | 2,250 |

Figure 11:
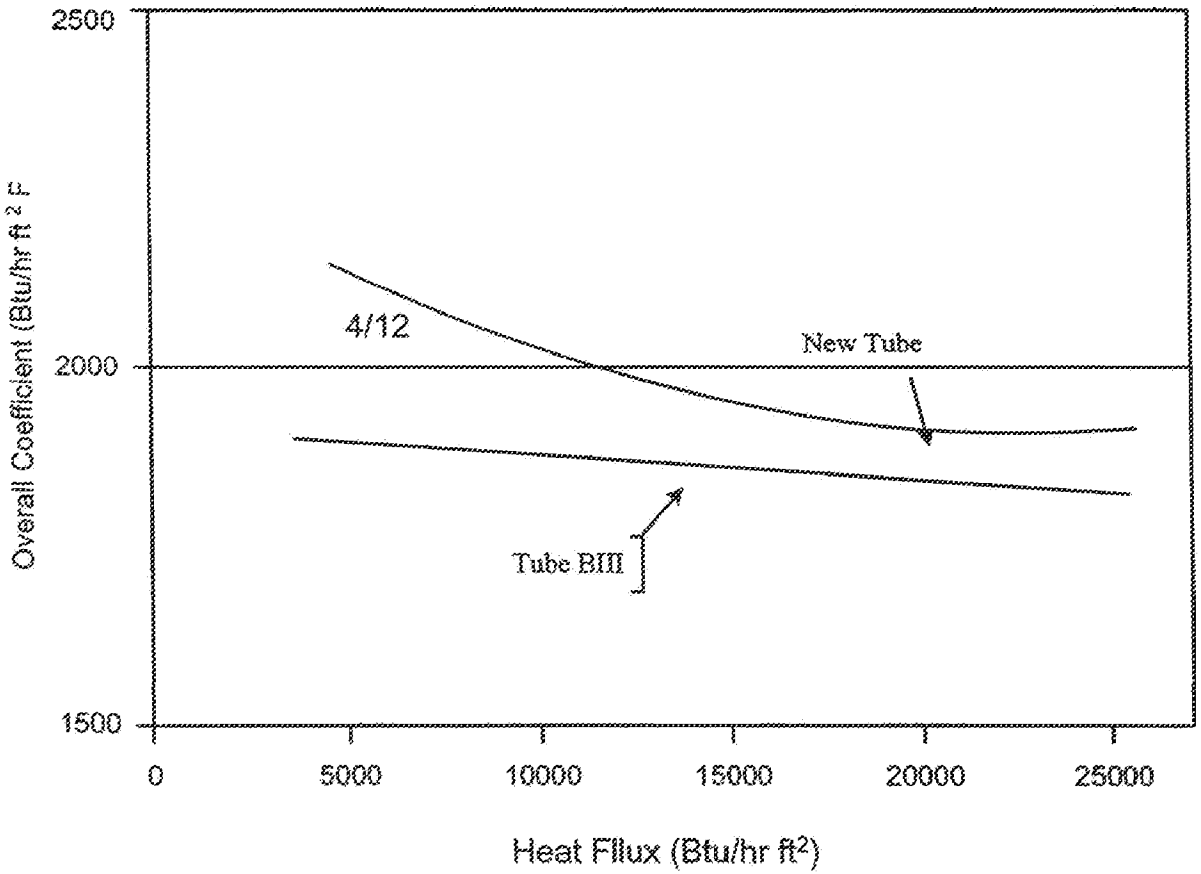
FIG. 11 is a graph comparing the overall heat transfer coefficient $U_o$ in refrigerant HFC-134a at varying heat fluxes, $Q/A_o$.

FIG. 11 is a graph comparing the overall heat transfer coefficient $U_o$ in HFC-134a refrigerant at varying heat fluxes, $Q/A_o$, for the New Tube and T-BIII® Tube. At a 7,000 (Btu/hr ft$^2$) heat flux, the enhancement of the New Tube over the T-BIII® Tube is 15% at a water flow rate of 5 GPM (also shown in Table 3).

The foregoing is provided for the purpose of illustrating, explaining and describing embodiments of the present invention. Further modifications and adaptations to these embodiments will be apparent to those skilled in the art and may be made without departing from the spirit of the invention or the scope of the following claims. Moreover, the person of ordinary skill in the art will appreciate that the present invention provides a fin having a unique profile that creates nucleate boiling sites having multiple cavities, such as a dual cavity. The present invention provides such a unique profile without shaving off any metal to create the pore, and then provides an improved manufacturing method of forming an improved heat transfer tube. Yet further, use of one or more of such tubes in a flooded chiller results in improved performance of the chiller in terms of heat transfer. Thus, the foregoing explanation and description of the preferred embodiments in exemplary, and the invention is set forth in the appended claims.

What is claimed is:

1. A heat transfer tube suitable for use in a refrigerant evaporator comprising an outer surface, the outer surface comprising:

a. a plurality of fins and a plurality of channels extending between the fins, wherein notches are formed in the fins; and b. at least one dual cavity nucleate boiling pore formed at the intersection of a notch and a channel, wherein the nucleate boiling pore comprises a first nucleate boiling cavity and a second nucleate boiling cavity, wherein the first nucleate boiling cavity is at least partially defined by at least a portion of the notch extending at least partially over the channel and wherein the second nucleate boiling cavity is at least partially defined by at least a portion of a notched fin extending at least partially over the notch.

2. The heat transfer tube of claim 1, wherein the heat transfer tube comprises between 40 and 70 fins.

3. The heat transfer tube of claim 1, wherein a plurality of root notches are formed in the plurality of channels.

4. The heat transfer tube of claim 3, wherein the root notches have a generally trapezoidal shape.

5. The heat transfer tube of claim 3, wherein the heat transfer tube comprises between 20 and 100 root notches per circumference of the tube.

6. The heat transfer tube of claim 3, wherein the root notches have a depth of between 0.0005 and 0.005 inches.

7. The heat transfer tube of claim 1, wherein the tube comprises an inner surface and the inner surface comprises helical ridges.

8. A method of fabricating a heat transfer tube having an inner surface and an outer surface, the method comprising:

(a) forming a plurality of fins on the outer surface of the tube, wherein a plurality of channels extend between adjacent fins;

(b) notching at least some of the fins to form a plurality of notches, wherein a first nucleate boiling cavity is at least partially defined by a channel and a notch; and (c) bending over or flattening at least a portion of a notched fin to form a second nucleate boiling cavity in communication with the first nucleate boiling cavity.

9. The method of claim 8, further comprising forming helical ridges on the inner surface of the tube.

10. The method of claim 8, wherein forming a plurality of fins on the outer surface of the tube comprises forming fins having a height between approximately 0.015 and 0.060 inches.

11. The method of claim 8, further comprising forming a plurality of root notches in at least some of the plurality of channels.

12. The method of claim 11, wherein the root notches have a generally trapezoidal shape.

13. The method of claim 11, wherein forming a plurality of root notches comprises forming between 20 and 100 root notches per circumference of the tube.

14. The method of claim 11, wherein the root notches have a depth of between 0.0005 and 0.005 inches.

15. An improved refrigerant evaporator, comprising:

a. a shell;

b. a refrigerant within the shell; and c. at least one heat transfer tube within the shell and in contact with the refrigerant, the heat transfer tube comprising:

i. an outer surface, said outer surface comprising a plurality of fins with channels extending between adjacent fins, wherein notches are formed in the fins; and ii. at least one dual cavity nucleate boiling pore formed at the intersection of a notch and a channel, wherein the nucleate boiling pore comprises a first nucleate boiling cavity and a second nucleate boiling cavity, wherein the first nucleate boiling cavity is at least partially defined by at least a portion of the notch extending at least partially over the channel and wherein the second nucleate boiling cavity is at least partially defined by at least a portion of a notched fin extending at least partially over the notch.

16. The evaporator of claim 15, wherein the heat transfer tube comprises between 40 and 70 fins.

17. The evaporator of claim 15, wherein a plurality of root notches are formed in the plurality of channels.

18. The evaporator of claim 15, wherein the root notches have a generally trapezoidal shape.

19. The evaporator of claim 17, wherein the root notches have a depth of between 0.0005 and 0.005 inches.

20. The evaporator of claim 15, wherein the tube further comprises an inner surface and the inner surface comprises helical ridges.

* * * * *